US009172189B2

(12) United States Patent
Gao et al.

(10) Patent No.: US 9,172,189 B2
(45) Date of Patent: Oct. 27, 2015

(54) HIGH SPEED MODULAR JACK HAVING CENTRAL SHIELD

(71) Applicant: HON HAI PRECISION INDUSTRY CO., LTD., New Taipei (TW)

(72) Inventors: Sheng-Pin Gao, Kunshan (CN); Chih-Ching Hsu, New Taipei (TW); Dao-Kuan Zhang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/467,070

(22) Filed: Aug. 25, 2014

(65) Prior Publication Data

US 2015/0056826 A1 Feb. 26, 2015

(30) Foreign Application Priority Data

Aug. 23, 2013 (CN) ..... 2013 2 05160188 U

(51) Int. Cl.

| | |
|---|---|
| ***H01R 13/66*** | (2006.01) |
| ***H01R 13/6587*** | (2011.01) |
| *H01R 24/64* | (2011.01) |
| *H01R 107/00* | (2006.01) |
| *H01R 12/72* | (2011.01) |

(52) U.S. Cl.

CPC ..... *H01R 13/6633* (2013.01); *H01R 13/6587* (2013.01); *H01R 12/722* (2013.01); *H01R 24/64* (2013.01); *H01R 2107/00* (2013.01); *H01R 2201/04* (2013.01)

(58) Field of Classification Search

CPC ..... H01R 23/025
USPC ..... 439/620.18, 620.11, 541.5, 540.1
See application file for complete search history.

(56) References Cited

U.S. PATENT DOCUMENTS

| | | | | |
|---|---|---|---|---|
| 6,227,911 | B1 * | 5/2001 | Boutros et al. | 439/620.18 |
| 6,511,348 | B1 * | 1/2003 | Wojtacki et al. | 439/620.18 |
| 6,537,110 | B1 | 3/2003 | Korsunsky et al. | |
| 7,052,315 | B2 | 5/2006 | Murr et al. | |
| 7,845,984 | B2 * | 12/2010 | Schaffer et al. | 439/620.18 |
| 8,449,332 | B2 * | 5/2013 | Purkis et al. | 439/620.18 |
| 2004/0132342 | A1 * | 7/2004 | Lien | 439/620 |
| 2009/0098766 | A1 * | 4/2009 | Steinke et al. | 439/541.5 |
| 2012/0196479 | A1 | 8/2012 | Chow et al. | |
| 2012/0309233 | A1 | 12/2012 | O'Malley et al. | |
| 2013/0130561 | A1 | 5/2013 | Regnier | |
| 2015/0024614 | A1 * | 1/2015 | Gao | 439/78 |
| 2015/0056817 | A1 * | 2/2015 | Ogawa et al. | 438/723 |
| 2015/0056825 | A1 * | 2/2015 | Hsu et al. | 439/78 |

* cited by examiner

*Primary Examiner* — Phuong Dinh
(74) *Attorney, Agent, or Firm* — Wei Te Chung; Ming Chieh Chang

(57) ABSTRACT

A modular jack includes an insulative housing, a set of central shields, and a set of insert modules. The modular jack defines a mounting port. Each insert module includes a printed circuit broad assembly (PCBA) disposed horizontally in the mounting port and a terminal module located below the PCBA. The terminal module has a set of first terminals, a set of second terminals, and an insulative carrier holding the first and second terminals. Each central shield is disposed between two adjacent insert modules and mounted to the insulative housing. The central shield has a metal wafer and an insulative body for holding the metal wafer. The insulative body includes a pressing face extending along a front-to-back direction and the insulative carrier has a receiving pressure face extending along the front-to-back direction. Each terminal has a mounting portion for electrically and mechanically engaged with an exterior PCB.

7 Claims, 9 Drawing Sheets

HIGH SPEED MODULAR JACK HAVING CENTRAL SHIELD

BACKGROUND OF THE INVENTION

1. Field of the Invention

The present invention relates to a modular jack suitable for high-speed communication, and more particularly to a RJ45 receptacle connector having central shields.

2. Description of Related Art

U.S. Patent Application Publication No. 2012/0196479, published on Aug. 2, 2012 discloses a modular jack used for 10 Gbps Ethernet. The modular jack includes an insulative housing with a mounting port, a row of insert modules inserted into the mounting port along a back-to-front direction, and a set of central shields each disposed between two adjacent insert modules. The insert module includes two vertical PCBs (printed circuit boards) and a plurality of terminals mounted to bottom portions of the vertical PCBs. Each terminal has a mounting portion for electrically and mechanically engaged with an exterior PCB. The central shield does not engage with the insert modules. When pressing the modular jack to the exterior PCB, force applied to the terminals may not be uniform.

U.S. Patent Application Publication No. 2012/0309233, published on Dec. 6, 2012, discloses a modular jack used for 10 Gbps Ethernet. The modular jack includes an insulative housing with a mounting port, a row of insert modules inserted into the mounting port along a back-to-front direction, and a set of central shields each disposed between two adjacent insert modules. Each central shield is made of metal plate with a thin thickness that could not afford a big pressing force.

Hence, a modular jack having an improved structure for mounting press-fit terminals is desired.

SUMMARY OF THE INVENTION

Accordingly, an object of the present invention is to provide a modular jack having a proper structure for mounting press-fit terminals.

In order to achieve the object set forth, the invention provides a modular jack including an insulative housing, a set of central shields, and a set of insert modules. The modular jack defines a row of lower ports, a row of upper ports, and a mounting port located behind the lower and upper ports. Each insert module is inserted from the mounting port to corresponding one lower port and one upper port. Each insert module includes a printed circuit broad assembly (PCBA) disposed horizontally in the mounting port and a terminal module located below the PCBA. The PCBA includes a top face, a bottom face, a set of upper contacts each having an upper contacting portion extending backwardly and upwardly in the upper port and an upper connecting portion mounted on the top face, a set of lower contacts each having a lower contacting portion extending backwardly and downwardly in the lower port and a connecting portion mounted on the bottom face. The terminal module has a set of first terminals electrically connected to the upper contacts through the PCBA, a set of second terminals electrically connected to the lower contacts through the PCBA, and an insulative carrier for holding the first and second terminals. Each central shield is disposed between two adjacent insert modules and mounted to the insulative housing. The central shield has a metal wafer and an insulative body holding the metal wafer. The insulative body includes a pressing face extending along a front-to-back direction and the insulative carrier has a receiving pressure face extending along the front-to-back direction. Each terminal has a mounting portion for electrically and mechanically engaged with an exterior PCB. The pressing face transmits a pressure to the receiving pressure face, when pressing the modular jack to the exterior PCB along a top-to-bottom direction.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-9, a 2×N-port modular jack 100 according to the present invention is shown. The modular jack 100 could be mounted on a horizontal mother PCB 200.

Figure 1:
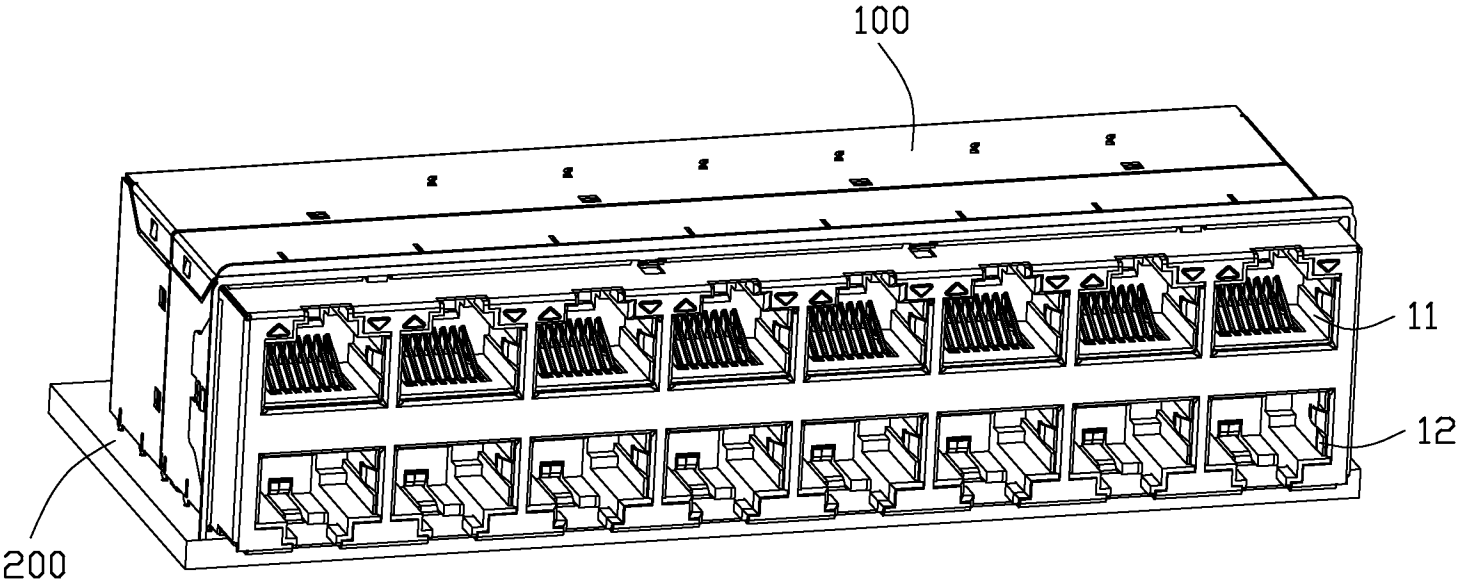
FIG. 1 is a perspective view of a modular jack according to the present invention, mounted on a horizontal mother printed circuit board (PCB)
Figure 2:
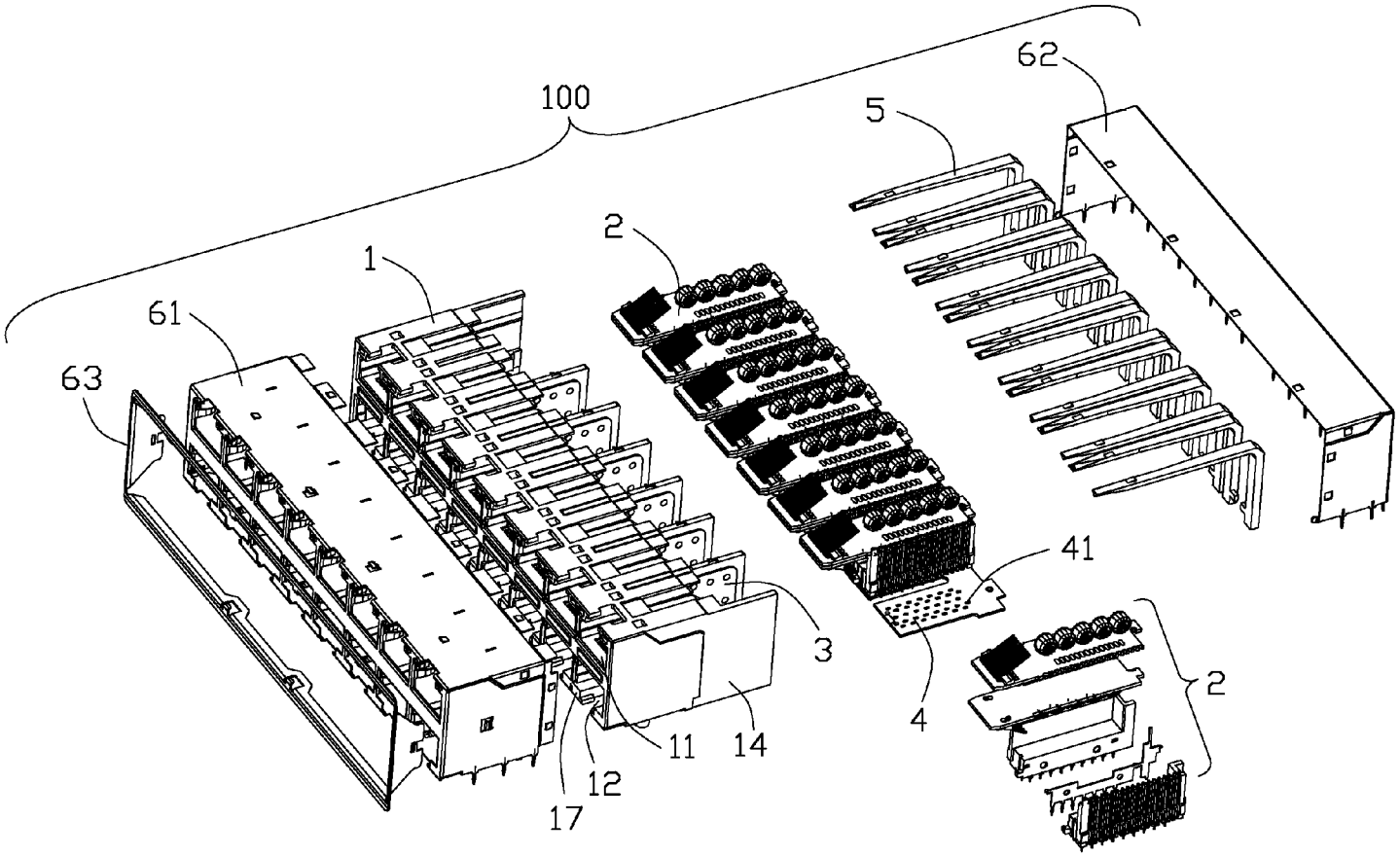
FIG. 2 is an exploded view of the modular jack shown in FIG. 1.

Referring to FIG. 2, the modular jack 100 includes an insulative housing 1, a plurality of insert modules 2 assembled to the insulative housing 1 along a back-to-front direction, a plurality of central shields 3 each disposed between two adjacent insert modules 2, a bottom PCB 4 mounted onto the insert modules 2 along a bottom-to-top direction, a plurality of light pipes 5 mounted to the insulative housing 1 along the back-to-front direction, and a shielding shell assembly enclosing the insulative housing 1. The shielding shell assembly includes a front metal shell 61, a rear metal shell 62 assembled with the front metal shell 61, and a metal frame 63 mounted to a front portion of the front metal shell 61.

Figure 3:
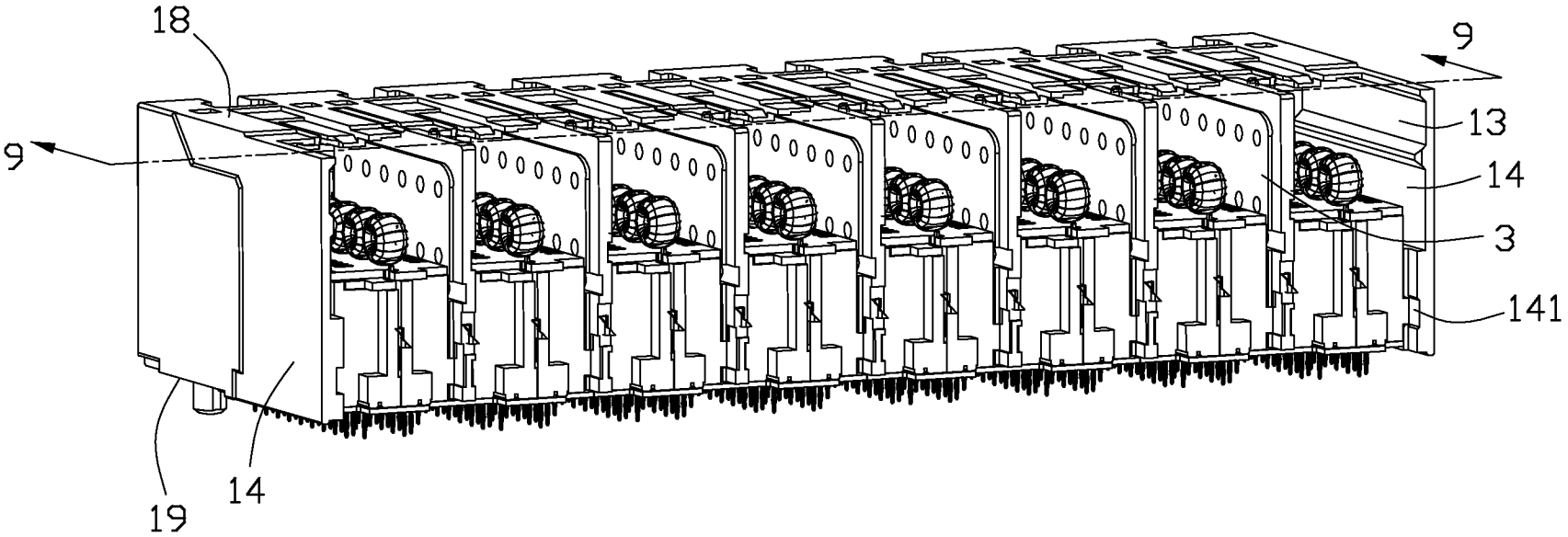
FIG. 3 is a perspective view of the modular jack shown in FIG. 1, with a shielding shell being removed.

Referring to FIGS. 2-3, the insulative housing 1 defines a row of lower ports 12 and a row of upper ports 11 vertically stacked in columns, each of which is used to receive a modular plug (not shown) with a high speed, e.g., 10 Gigabit/second. The insulative housing 1 also defines a mounting port 13 located behind the upper and lower ports 11, 12. Each insert module 2 is inserted from the mounting port 13 into corresponding one lower port 12 and one upper port 11. The insulative housing 1 includes a front wall 17, a top wall 18, a lower wall 19, and two side walls 14. The upper and lower ports 11, 12 are recessed from the front wall 17 along a front-to-back direction. The lower wall 19 is used for mounting onto the horizontal mother PCB 200.

Referring to FIGS. 4-7, each insert module 2 includes a horizontal PCBA (printed circuit board assembly) 20 and a terminal module 21 located below the horizontal PCBA 20. The PCBA 20 includes a top face 2011, a bottom face 2021, and a plurality of isolation transformers 203, 204 mounted thereon. The PCBA includes a lower PCB 202 and an upper PCB 201 stacked thereon. The upper PCB 201 includes the top face 2011 with two rows of conductive pads 2012 exposed thereon. Similarly, the lower PCB 202 includes a bottom face 2021 with two rows of conductive pads (not shown) exposed thereon. The isolation transformers 203, 204 include a set of upper transformers 203 mounted on the top face 2011 and a set of lower transformers 204 mounted on the bottom face 2021. Each upper transformer 203 includes a torrid core 2031 disposed between the two rows of conductive pads 2012 and a plurality of coils 2032 winding around the torrid core 2031. Similarly, each lower transformer 204 includes a torrid core 2041 disposed between the two rows of conductive pads of the lower PCB 202 and a plurality of coils 2042 winding around the torrid core 2041. The ends of the coils 2032, 2042 are soldered to corresponding conductive pads 2012 through an automatic soldering machine. Each of the upper and lower PCBs 201, 202 also has a plurality of common mode chokes (not shown), capacitors (not shown), and resistances (not shown) mounted thereon. Each transformer 203, 204 electrically connects corresponding common mode choke through traces of the PCBA 20. The capacitors and resistances are used for forming a Bob-Smith circuit. The isolation transformers 203, 204 are mounted on the upper and bottom faces 2011, 2021 of the PCBA 20 that the isolation transformers 203, 204 could be automatically soldered to the PCBA 20. The room of the PCBA 20 is full utilized through two opposite faces of the PCBA 20 mounted with the isolation transformer 203, 204. The PCBA 20 also could be replaced by one muti-layer PCB, however the cost of the muti-layer PCB would be high. If the isolative transformers 203, 204 soldered on two opposite faces of the muti-layer PCB, it is complex for turning the muti-layer PCB over for soldering.

The PCBA 20 includes an upper plastic body 207, a set of upper contacts 205 insert molded with the upper plastic body 207, a lower plastic body 208, and a set of lower contacts 206 insert molded with the lower plastic body 208. The upper plastic body 207 is mounted on the top face 2011 and each upper contact 205 is soldered on the top face 2011. The lower plastic body 208 is mounted on the bottom face 2021 and each lower contact 206 is soldered on the bottom face 2021. Each upper contact 205 has an upper contacting portion 2052 extending backwardly and upwardly in the upper port 11 and a connecting portion 2051 surface mounted on a front portion of the top face 2011. Each lower contact 206 has a lower contacting portion 2062 extending backwardly and downwardly in the lower port 12 and a connecting portion (not labeled) surface mounted on a front portion of the bottom face 2021.

Figure 4:
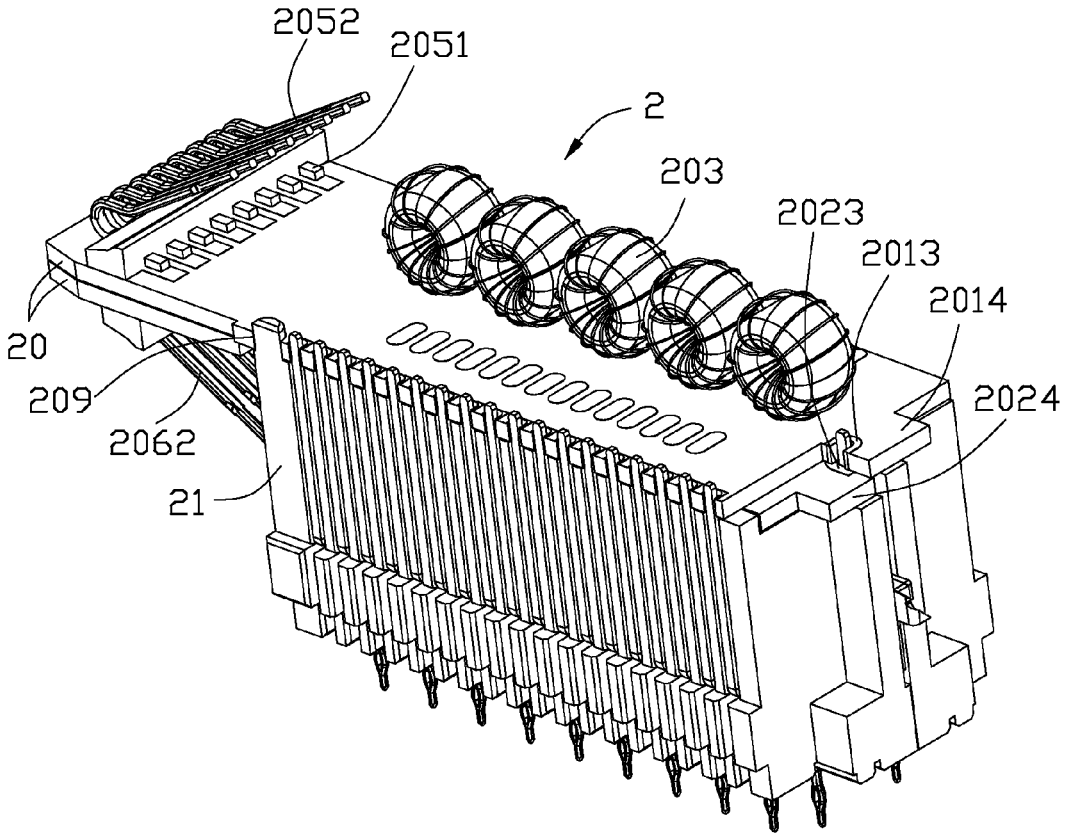
FIG. 4 is a perspective view of an insert module shown in FIG. 1.
Figure 5:
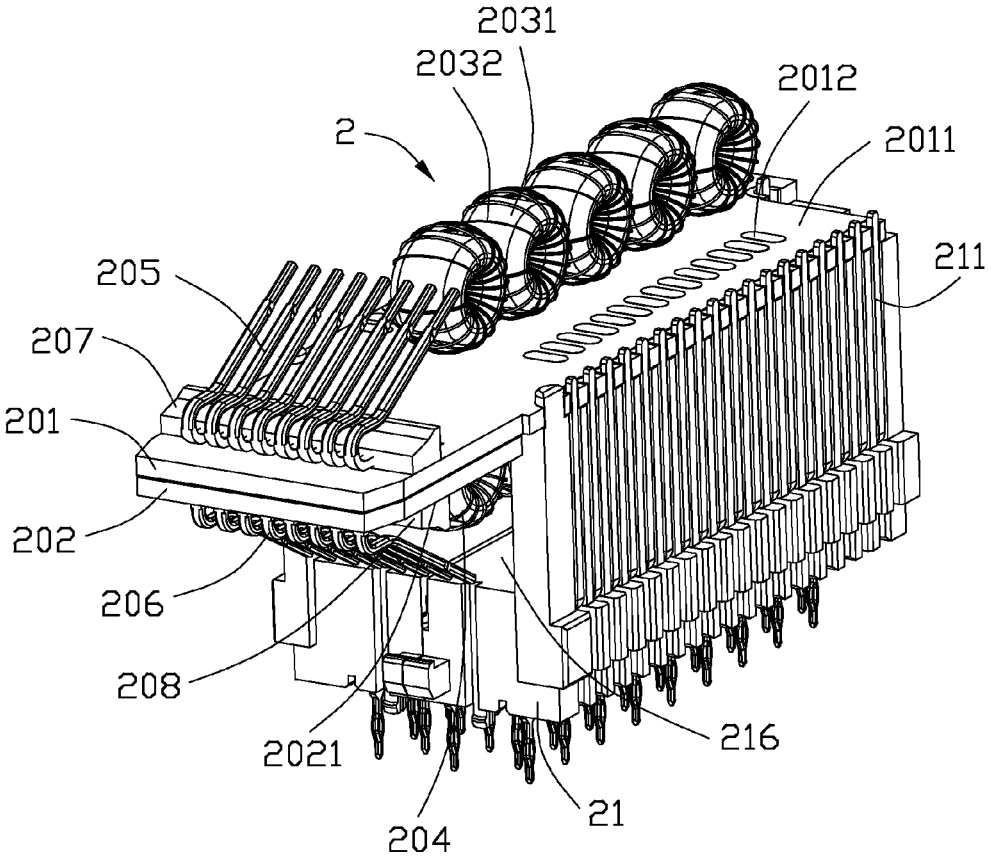
FIG. 5 is another perspective view of the insert module shown in FIG. 4.
Figure 6:
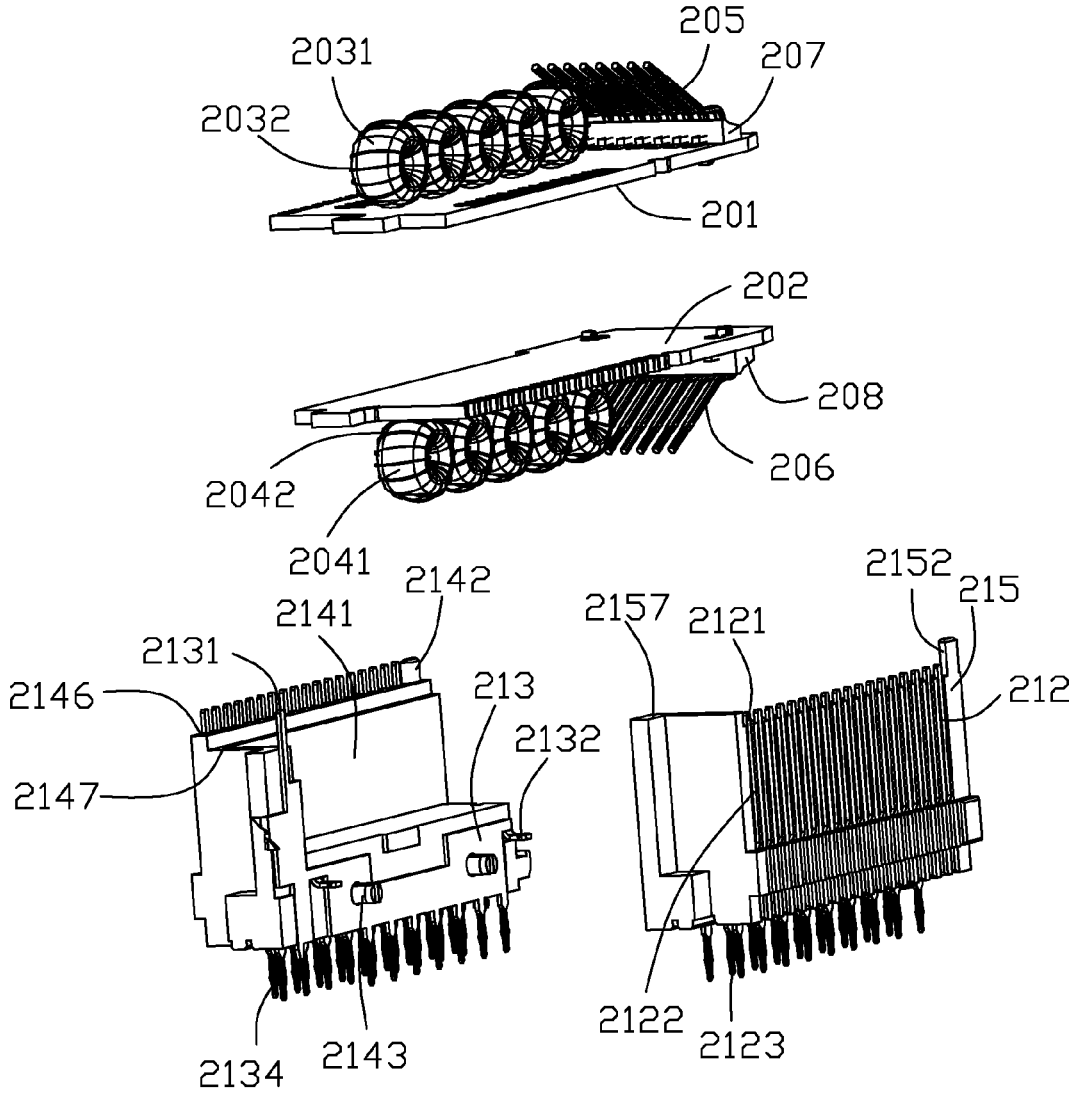
FIG. 6 is an exploded view of the insert module shown in FIG. 4.
Figure 7:
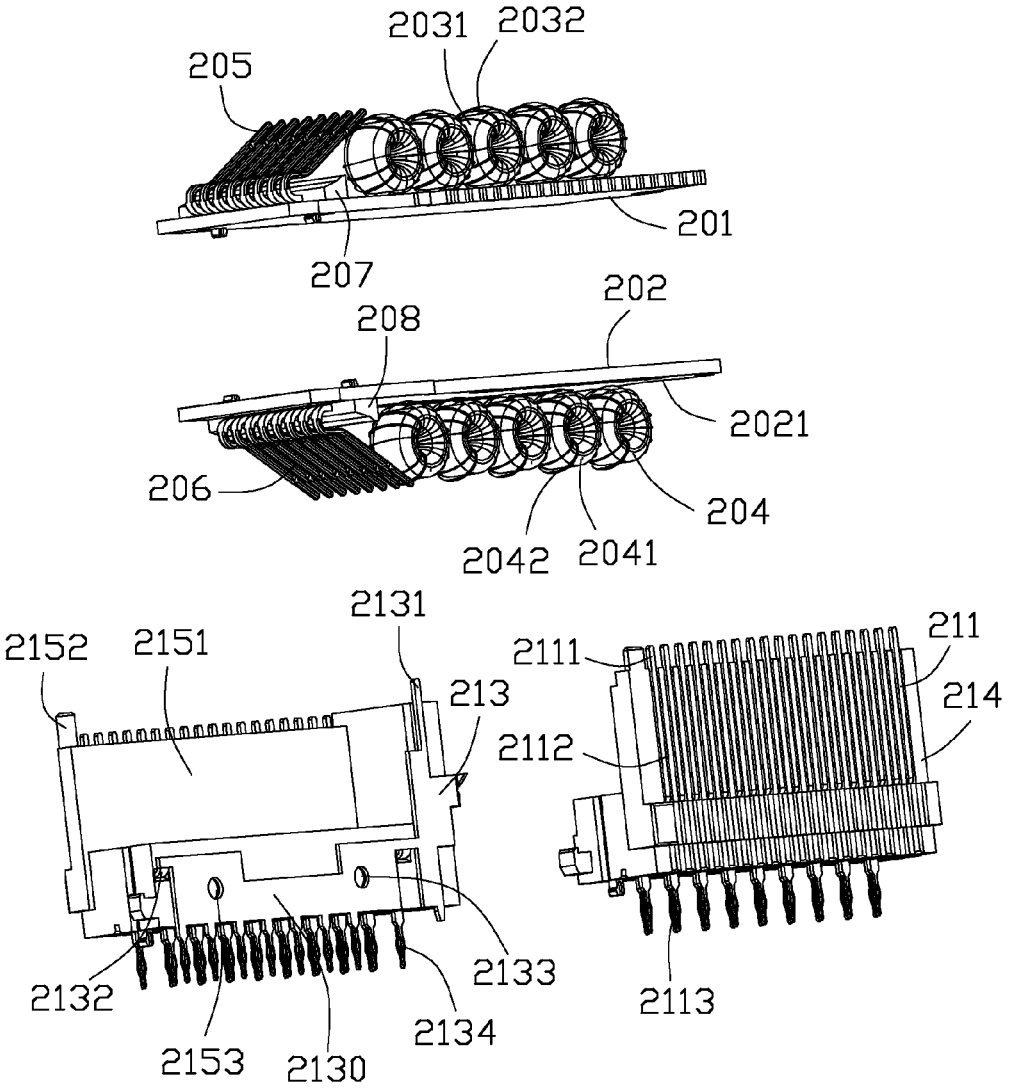
FIG. 7 is another exploded view of the insert module shown in FIG. 6.

Referring to FIG. 4, the upper PCB 201 has an upper rear tail 2014 with a left edge and an upper cut 2013 recessed therefrom along a left-to-right direction. The lower PCB 202 has a lower rear tail 2024 with a right edge and a lower cut 2023 recessed therefrom along a right-to-left direction. The upper and lower tails 2014, 2024 are shifted in the bottom-to-top direction. The upper rear tail 2014 protrudes from a rear portion of the upper PCB 201 along a front-to-back direction. The lower tail 2024 protrudes from a rear portion of the lower PCB 202 along the front-to-back direction. The upper cut 2013 is disposed at least partially overlapped with the lower cut 2023 in the vertical direction. The upper cut 2013 and the lower cut 2023 are conductive vias for electrically connecting with ground layers of upper PCB 201 and the lower PCB 202 respectively.

The terminal module 21 includes a set of first terminals 211 connected with the upper PCB 201, a set of second terminals 212 connected with the lower PCB 202, and a metal shielding plate 213 disposed between the first and second terminals 211, 212. The upper contacts 205 electrically connect with corresponding first terminals 211 through the upper PCB 201 and the upper transformers 203. The lower contacts 206 electrically connect with corresponding second terminals 212 through the lower PCB 202 and the lower transformers 204. The metal shielding plate 213 is used for shielding electromagnetic interference (EMI) between the first and second terminals when they transmitting signals. The terminal module 21 has a first insulative carrier 214 for retention of the first terminals 211 and a second insulative carrier 215 for retention of the second terminals 212. The metal shielding plate 213 is sandwiched between the first and second insulative carriers 214, 215. There is a receiving chamber 216 defined by the first insulative carrier 214 and the second insulative carrier 215. The lower transformers 204 mounted on the lower PCB 202 are received in the receiving chamber 216. The first insulative carrier 214 has a first receiving chamber 2141 and the second insulative carrier 215 has a second receiving chamber 2151. The first receiving chamber 2141 and the second receiving chamber 2151 assembled to form the receiving chamber 216. The first insulative carrier 214 has a first post 2142 mounting into a through hole 209 of the upper PCB 201. The second insulative carrier 215 has a second post 2152 mounting a through hole (not labeled) of the lower PCB 202. The first insulative carrier 214 has a positioning post 2143 and the second insulative carrier 215 has a positioning hole 2153 for the positioning post 2143 inserting therein. Each first terminal 211 includes a first connecting portion 2111 connecting with the upper PCB 201, a first holding portion 2112 held by the first insulative carrier 214, and a first mounting portion 2113 located below the bottom PCB 4. The second terminal 212 includes a second connecting portion 2121 connecting with the lower PCB 201, a second holding portion 2122 held by the second insulative carrier 215, and a second mounting portion 2123 located below the bottom PCB 4. The first mounting portion 2113 and the second mounting portion 2123 are used for electrically and mechanically engagement with the horizontal mother PCB 200. The first insulative carrier 214 has a first supporting face 2146 and a second supporting face 2147 located below the first supporting face 2146. The second carrier 215 having a third supporting face 2157 disposed at a same level with the second supporting face 2147. The upper PCB 201 is supported by the first supporting face 2146 and the lower PCB 202. The lower PCB 202 is supported by the second face 2147 and the third supporting face 2157.

The metal shielding plate 213 has a main body portion 2130, a top inserting section 2131 extending upwardly from the main body portion 2130, and a mounting portion 2134 extending downwardly from the main body portion 2130. The main body portion 2130 defines two holes 20133 for the positioning post 2143 passing over. The mounting portions 2134 are used for electrically and mechanically engagement with the horizontal mother board 200. The top inserting section 2131 is inserted into the first cutout 2013 and the second cutout 2023. The top inserting section 2131 is soldered to the upper PCB 201 and the lower PCB 202 by only one process.

Figure 8:
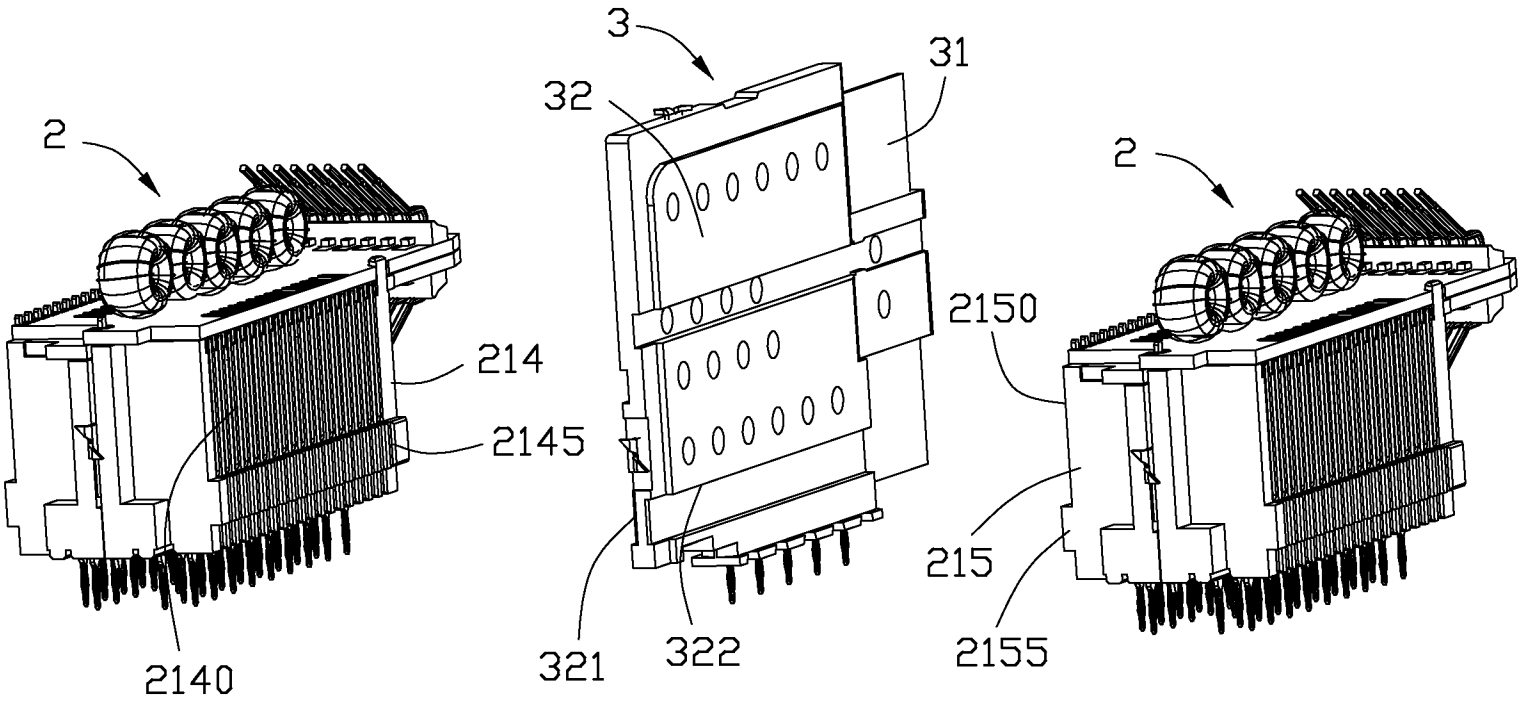
FIG. 8 is a perspective view of two adjacent insert modules and a central shield positioned therebeween.
Figure 9:
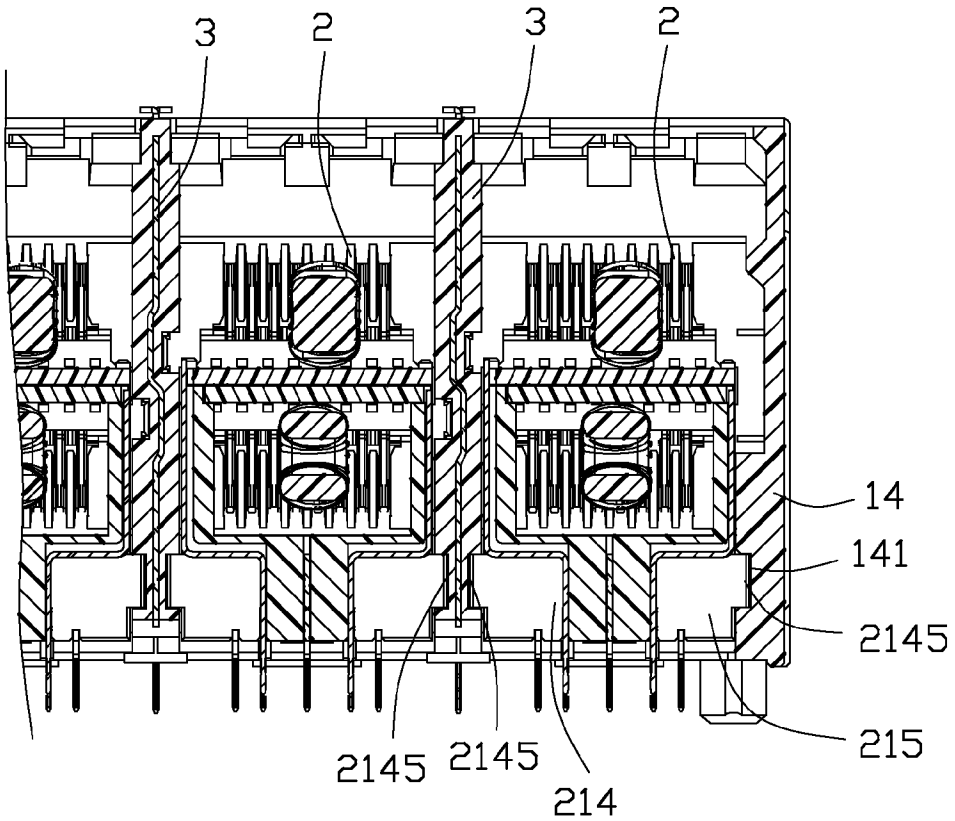
FIG. 9 is a part cross-sectional view of the modular jack, taken along line 9-9 of FIG. 1.

Referring to FIGS. 8-9, the insert module 2 is disposed between two adjacent central shields 3 or between one central shield 3 and one side wall 14 of the insulative housing 1. The central shield 3 includes an insulative body 32 and a metal wafer 31 insert molded with the insulative body 32. The first insulative carrier 214 has two side wall 2140 each having a first pressing protrusion 2145 protruding therefrom and extending along the front-to-back direction. The second insulative carrier 215 has two side wall 2150 each having a second pressing protrusion 2155 protruding therefrom and extending along the front-to-back direction. The insulative body 32 defines a left slot 321 and a right slot 322. The first pressing protrusion 2145 and the second pressing protrusion 2155 are received in the left slot 321 and the right slot 322 respectively. Each pressing protrusion 2145, 2155 includes a pressing face (not labeled) extending along a front-to-back direction and each insulative carrier has a receiving pressure face (not labeled) facing upwardly. The central shield 3 could press the first insulative carrier and the second insulative carrier respectively through the pressing protrusions 2145, 2155 and the slots 321, 322 for transferring the press force, when the modular jack is press-mounted to the horizontal PCB 200 along a top-to-bottom direction.

Referring to FIGS. 2-9, the insulative housing 1 defines two inner passageways 141 at the two side walls 14 of the insulative housing 1. The inner passageways 141 are used for receiving the pressing protrusions 2145, 2155.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A modular jack comprising:

an insulative housing defining a row of lower ports, a row of upper ports, and a mounting port located behind the lower and upper ports;

a set of insert modules each inserted from the mounting port to corresponding one lower port and one upper port, each insert module including a printed circuit broad assembly (PCBA) disposed horizontally in the mounting port and a terminal module located below the PCBA; the PCBA including a top face, a bottom face, a set of upper contacts each having an upper contacting portion extending backwardly and upwardly in the upper port and an upper connecting portion mounted on the top face, a set of lower contacts each having a lower contacting portion extending backwardly and downwardly in the lower port and a connecting portion mounted on the bottom face; the terminal module having a set of first terminals electrically connected to the upper contacts through the PCBA, a set of second terminals electrically connected to the lower contacts through the PCBA, and an insulative carrier for holding the first and second terminals; and a set of central shields each disposed between two adjacent insert modules and mounted to the insulative housing, the central shield having a metal wafer and an insulative body holding the metal wafer; wherein the insulative body includes a pressing face extending along a front-to-back direction and the insulative carrier has a receiving pressure face extending along the front-to-back direction, each terminal having a mounting portion for electrically and mechanically engaged with an exterior PCB, when pressing the modular jack to the exterior PCB along a top-to-bottom direction, the pressing face transmitting a pressure to the receiving pressure face, wherein said insulative carrier has a pressing protrusion protruding toward the central shield and said central shield has a slot extending along the front-to-back direction for receiving the pressing protrusion, the pressing protrusion having the pressing face facing downwardly, the slot having the receiving pressure face facing upwardly, wherein said insulative housing has two side walls extending vertically along the front-to-back direction, said insert module disposed between two central shields or between one central shield and one side wall of the insulative housing, wherein said insulative carrier has a pressing protrusion protruding toward the side wall and the side wall has an inner passageway for receiving the pressing protrusion, wherein said insulative housing has a top wall connecting with the two side walls, the insert module extending backwardly beyond the top wall, wherein there is a gap between the insert module and the top wall along the top-to-bottom direction.

2. The modular jack as claimed in claim 1, wherein said metal wafer is insert molded with the insulative body.

3. The modular jack as claimed in claim 1, further including a shielding shell enclosing the insulative housing, the insert modules, and the central shields.

4. The modular jack as claimed in claim 1, further including a plurality of upper transformers mounted on the upper face and a plurality of lower transformers mounted on the bottom face.

5. The modular jack as claimed in claim 4, wherein each transformer has a magnetic core and a plurality of coils wound around the magnetic, and the PCBA includes a plurality conductive pads exposed on the upper and bottom faces, the coils including a plurality of ends connecting to corresponding conductive pads.

6. An electrical connector comprising:

an insulative housing defining a front mating portion of an RJ45 configuration, and a rear connecting port along a front-to-back direction;

a printed circuit board assembly (PCBA) forwardly assembled into the housing along said front-to-back direction, and including:

at least one printed circuit board extending in a horizontal plane defined by the front-to-back direction and a transverse direction perpendicular to said front-to-back direction;

a plurality of mating contacts connected to a front region of the printed circuit board and extending into the front mating port;

a plurality of electronic components mounted to the printed circuit board;

a terminal module mounted to a rear region of and located under the printed circuit board, said terminal module including a plurality of mounting terminals having upper sections upwardly connected to the printed circuit board and lower sections for downwardly connecting to an external printed circuit board on which the housing is seated; wherein the housing and the terminal module are engaged with each other so as to transfer a force imposed upon the housing to the terminal module for efficiently mounting the mounting terminals upon the external printed circuit board, wherein one of said housing and said terminal module forms a horizontal slot, and the other of said housing and said terminal module forms a pressing protrusion received in said horizontal slot to not only transfer the force to the terminal module but also guide insert the PCBA into the housing forwardly along said front-to-back direction, wherein said horizontal slot is formed in the housing, and the pressing protrusion is formed on the terminal module, wherein the electronic components are located under the printed circuit board and beside the terminal module in the transverse direction.

7. An electrical connector comprising:

an insulative housing defining a front mating port and a rear connecting port along a front-to-back direction, said front mating port further divided into an upper mating port and a lower mating port each being of an RJ 45 configuration;

a printed circuit board assembly (PCBA) forwardly assembled into the housing along said front-to-back direction, and including:

two stacked printed circuit boards each extending in a horizontal plane defined by the front-to-back direction and a transverse direction perpendicular to said front-to-back direction;

a plurality of upper mating contacts connected to a front region of an upper surface of the upper printed circuit board and extending into the upper mating port;

a plurality of lower mating contacts connected to a front region of an undersurface of the lower printed circuit board;

a plurality of electronic components mounted upon at lest one of the upper printed circuit board and the lower printed circuit board;

first and second terminal modules mounted to a rear region of and located under the lower printed circuit board, the first terminal module including a plurality of first mounting terminals having first upper sections upwardly connected to the upper printed circuit board and first lower sections for downwardly connecting to an external printed circuit board on which the housing is seated, the second terminal module including a plurality of second mounting terminals having second upper sections upwardly connected to the lower printed circuit board and second lower sections for downwardly connecting to the external printed circuit board; wherein the housing and each of the terminal module are engaged with each other so as to transfer a force imposed upon the housing to the terminal module for efficiently mounting the mounting terminals upon the external printed circuit board, wherein the electronic components are located under the lower printed circuit board, and between said first terminal module and said second terminal module in the transverse direction, wherein one of said housing and each terminal module forms a horizontal slot, and the other of said housing and each terminal module forms a pressing protrusion received in said horizontal slot to not only transfer the force to the terminal module but also guide insert the PCBA into the housing forwardly along said front-to-back direction, wherein said horizontal slot is formed in the housing, and the pressing protrusion is formed on each terminal module.

* * * * *